US006325640B1

(12) United States Patent
Kasai

(10) Patent No.: US 6,325,640 B1
(45) **Date of Patent: *Dec. 4, 2001**

(54) ELECTRICAL JUNCTION BOX HAVING A BUS BAR

(75) Inventor: Koji Kasai, Yokkaichi (JP)

(73) Assignee: Sumitomo Wiring Systems Ltd., Mie (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/477,412

(22) Filed: Jan. 4, 2000

(30) Foreign Application Priority Data

Jan. 4, 1999 (JP) ..... 11-000088
Jan. 8, 1999 (JP) ..... 11-003493
Jan. 8, 1999 (JP) ..... 11-003513

(51) Int. Cl.[7] ..... H01R 12/00
(52) U.S. Cl. ..... 439/76.2; 439/949; 174/71 B
(58) Field of Search ..... 439/76.2, 949, 439/212; 174/71 B, 70 B

(56) References Cited

U.S. PATENT DOCUMENTS 5,160,274 * 11/1992 Ozaki et al. ..... 439/949
5,530,625 6/1996 VanDer Stuyf et al. ..... 439/949
5,908,322 * 6/1999 Seki ..... 439/949

FOREIGN PATENT DOCUMENTS 520165 3/1931 (DE) .
1875590 7/1963 (DE) .
0887884 12/1998 (EP) .
64-16072 1/1989 (JP) .
05174940 7/1993 (JP) .
8-307032 11/1996 (JP) .

* cited by examiner

*Primary Examiner*—Tulsidas Patel
(74) *Attorney, Agent, or Firm*—Oliff & Berridge PLC

(57) ABSTRACT

An electrical junction box, for use in vehicles, having a bus bar with a spine with a plurality of one-piece metal strip parts joined together at mutually overlapping portions, and at least one one-piece terminal part each one piece terminal part having a foot portion and a terminal-forming portion. The foot portion lies flat against and is joined to the spine.

13 Claims, 16 Drawing Sheets

FIG. 3 (A)
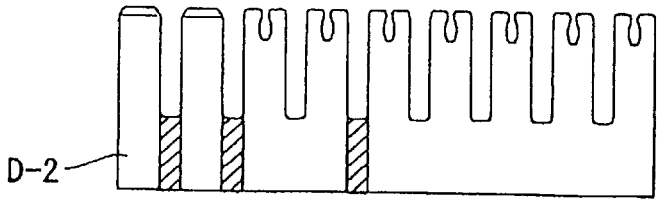
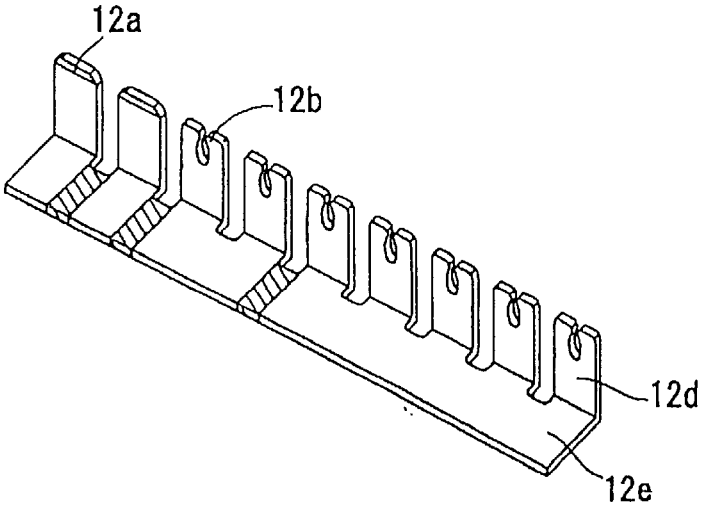
FIG. 3 (B)
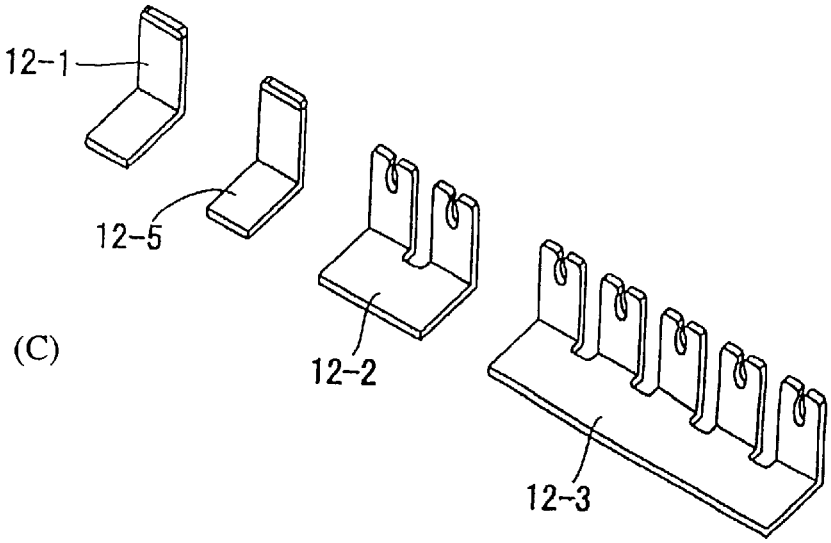
FIG. 3 (C)

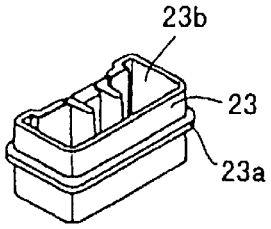
FIG. 8 (A)
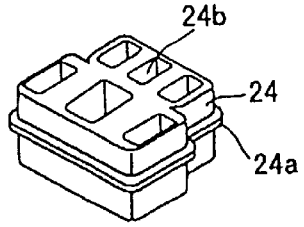
FIG. 8 (B)
FIG. 8 (C)
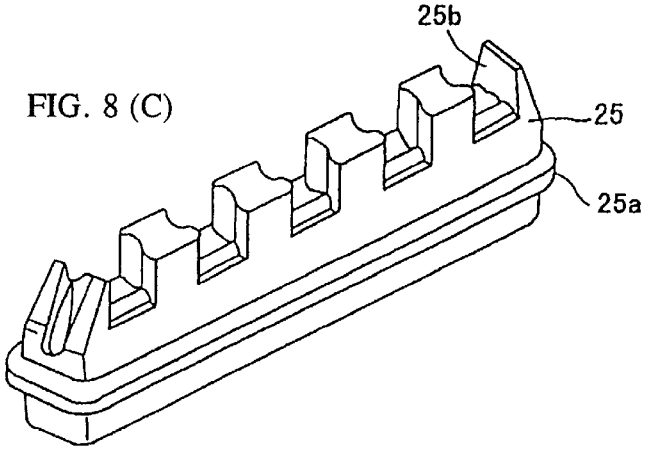
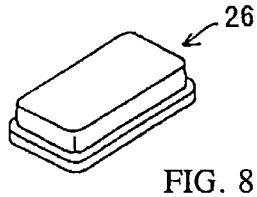
FIG. 8 (D)
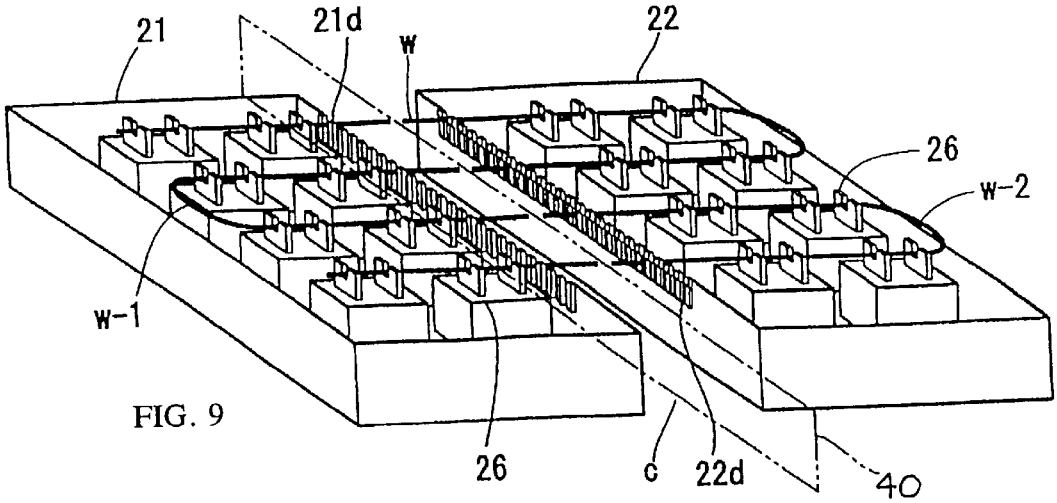
FIG. 9

ELECTRICAL JUNCTION BOX HAVING A BUS BAR

FIELD OF THE INVENTION

This invention relates to electrical junction boxes having one or more bus bars.

DESCRIPTION OF THE PRIOR ART

In a conventional electric junction box accommodating a branch circuit, electrical wires and a bus bar are connected with each other by pressure-contact to construct a high-density circuit. The bus bar is frequently used as a power source circuit through which high current flows.

For example, inside a lower case 1 and an upper case 2 of a conventional electrical junction box shown in FIG. 10, a wiring layer w-1 of single-core wire is arranged as a lower layer, a first insulation plate 6A is laminated on the wiring w-1, a bus bar 7 is laminated on the first insulation plate 6A, a second insulation plate 6B is laminated on the bus bar 7, and a second wiring layer w-2 is arranged as an upper layer. Terminals such as a slot terminal 7A projecting from the bus bar 7 and having a pressure-contact blade at its end, are connected with the wirings w-1 and w-2 by pressure-contact. Further, a pressure-contact terminal 5 and a female terminal (not shown) are provided on a connector 3 and a relay socket 4 integral with the lower case 1 and the upper case 2 and connect with the wiring w-1 and w-2. In this manner, a high-density internal circuit is constructed.

The bus bar 7 in the electric junction box of FIG. 10 is formed by punching a metal sheet into the required configuration, then bending and shaping the sheet. Because the internal circuit is formed for a specific type of a vehicle and a precise specification, bus bars of various different complicated configurations are required for different vehicles and specifications. A different punching die is necessary for each different punching configuration. Thus, it is necessary to manufacture many types of dies, which is expensive. When there is an improvement which alters an internal circuit in a given vehicle or specification, the existing bus bar cannot be used for the altered internal circuit. When that happens, it is necessary to design and manufacture a new bus bar, which requires time and labor.

In addition, the configuration of the upper and lower cases constituting the electric junction box are formed in correspondence to the configuration of the internal circuit. That is, they are specifically used for a particular type of a vehicle and a particular specification. Thus, it is necessary to manufacture many types of upper and lower cases, which increases cost.

U.S. Pat. No. 5,530,625 shows an electrical interface board, for use in a vehicle, having conductor elements formed by bending flat ribbon stock, to avoid the need to provide new tooling for each change of configuration. Terminal parts are connected flat to the conductor elements by clinch joints. However, only limited possibilities for the shape of the conductor elements are shown.

SUMMARY OF THE INVENTION

It is a first object of the present invention to provide, for an electrical junction box, a bus bar which can be easily made and can be applied to a wide variety of uses at a low cost to different types of vehicles and to alterations of a circuit. It is a second object of the present invention to make it possible to standardize a lower case and an upper case of an electrical junction box so that the lower and upper cases have general-purpose applicability, i.e., they are applicable to circuits of various configurations.

According to the invention in a first aspect there is provided an electrical junction box having at least one bus bar having

- a spine comprising a plurality of one-piece metal strip parts joined together at mutually overlapping portions thereof, and
- a plurality of terminal parts of metal sheet each having a foot portion and a terminal-forming portion, each said foot portion lying flat against the spine and being joined to the spine.

Each terminal part is preferably a one-piece part formed of metal sheet, and may be selected from (i) an L-shaped part in which the foot portion is one leg of the L-shape and (ii) a U-shaped part in which the foot portion is the base of the U-shape. In other embodiments, the foot portion of each said terminal part is coplanar with at least part of the terminal-forming portion thereof.

As shown below, the invention permits the design and production in a simple manner of bus bars in electrical junction boxes having a wide variety of configurations, using simple starting materials, e.g. metal strip, and standardized terminal parts. Small changes of specification of an electrical junction box can be easily accommodated, without the need for a new sheet punching tool. Interlayer connections in the box can be easily provided, and also connections to other standard items in the box, e.g. connectors, relays and fuses. Joining of the one-piece members to each other in the specific desired configuration can be achieved securely and simply, using automatic machinery, e.g. by welding or riveting. The overlap between the parts may be linear, perpendicular or oblique. The invention thus achieves flexibility of design at low cost.

For example, the one-piece metal strip parts of the spine are all formed of metal strip having uniform strip width. The metal strip parts are suitably joined together by riveting or welding, and the foot portions of the terminal parts also may be joined to the spine by riveting or welding. The spine may have a branched structure, with at least one terminal part joined to each branch of the branched structure.

To provide direction changes in the bus bar, at least one of the one-piece metal strip parts of the spine may have at least one oblique bend line at which are joined two adjacent portions thereof which lie in parallel planes and extend in different directions with mutual overlap. Additionally or alternatively, at least one of the one-piece metal strip parts of the spine has at least one right-angle bend at which are joined two adjacent portions which are in mutually perpendicular planes.

In another aspect, the invention provides an electrical junction box having at least one bus bar, the bus bar comprising

- a one-piece spine member in the form of a metal sheet strip having (i) at least one first bend at an oblique bend line at which are joined two adjacent portions thereof which lie in parallel planes and extend in different directions with mutual overlap, and (ii) at least one second bend which is a right-angle bend at which are joined two adjacent portions thereof which are in mutually perpendicular planes, and
- at least one terminal part formed of one piece of sheet strip bent to provide a foot portion and an upright portion perpendicular to said foot portion, said foot portion lying flat against said spine member and being joined thereto.

In the electrical junction box according to the invention, for use in a vehicle, the bus bar is suitable as a power source circuit.

The electrical junction box may have an upper casing part and a lower casing part, first electrical wiring extending over an inner surface of the upper casing part, second electrical wiring extending over an inner surface of the lower casing part, pressure-contact terminals disposed on the upper casing part and connected to the first wiring, pressure-contact terminals disposed on the lower casing part and connected to the second wiring, and electrical connection members disposed within the box and connecting the first and second wirings, wherein the bus bar is disposed in the box between the first and second wirings.

The invention extends to a vehicle including an electrical junction box as herein described.

It should be appreciated that the methods and apparatuses according to the invention are applicable to a wide variety of electrical junction situations. Thus, while the methods and apparatuses in accordance with the invention may be directed towards an electrical junction box in a vehicle, it should be recognized that electrical junction boxes and bus bars may be generated and manipulated in accordance with the invention in various ways to fit specific configurations. Further, it should be recognized that the methods and apparatuses described herein can be used in conjunction with various other apparatuses and methods.

BRIEF DESCRIPTION OF THE DRAWINGS

Exemplary embodiments of the invention will now be described by way of non-limitative example with reference to the accompanying drawings. In the drawings:

FIGS. 3(A), 3(B) and 3(C) are views showing the process of producing approximately L-shaped terminal-forming members of the bus bar of FIG. 1.

FIG. 8(A) are perspective views showing a connector of the junction box of FIG. 6.

FIG. 8(B) is a perspective view showing a relay socket of the junction box of FIG. 6.

FIG. 8(C) is a perspective view showing a fuse socket of the junction box of FIG. 6.

FIG. 8(D) is a perspective view showing a closing cover of the junction box of FIG. 6.

FIG. 9 is a perspective view showing the process of producing an electrical junction box.

DESCRIPTION OF THE PREFERRED EMBODIMENTS

Figure 1:
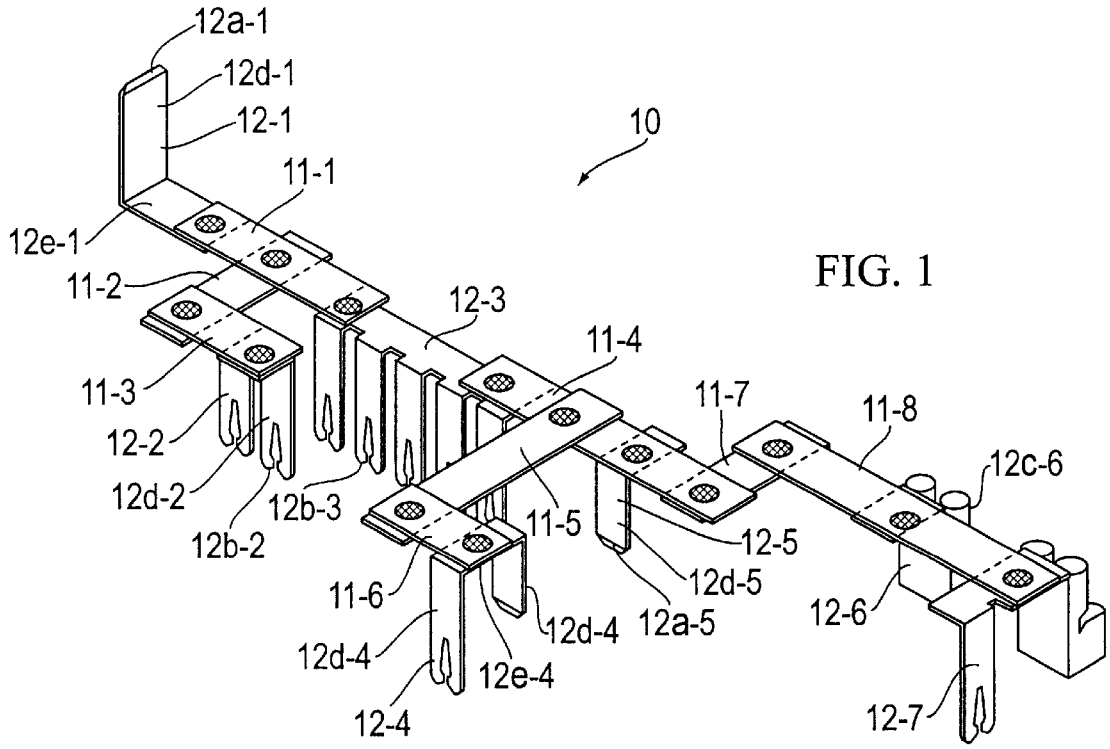
FIG. 1 is a perspective view showing a first bus bar used in an electrical junction box of the present invention.
Figure 6:
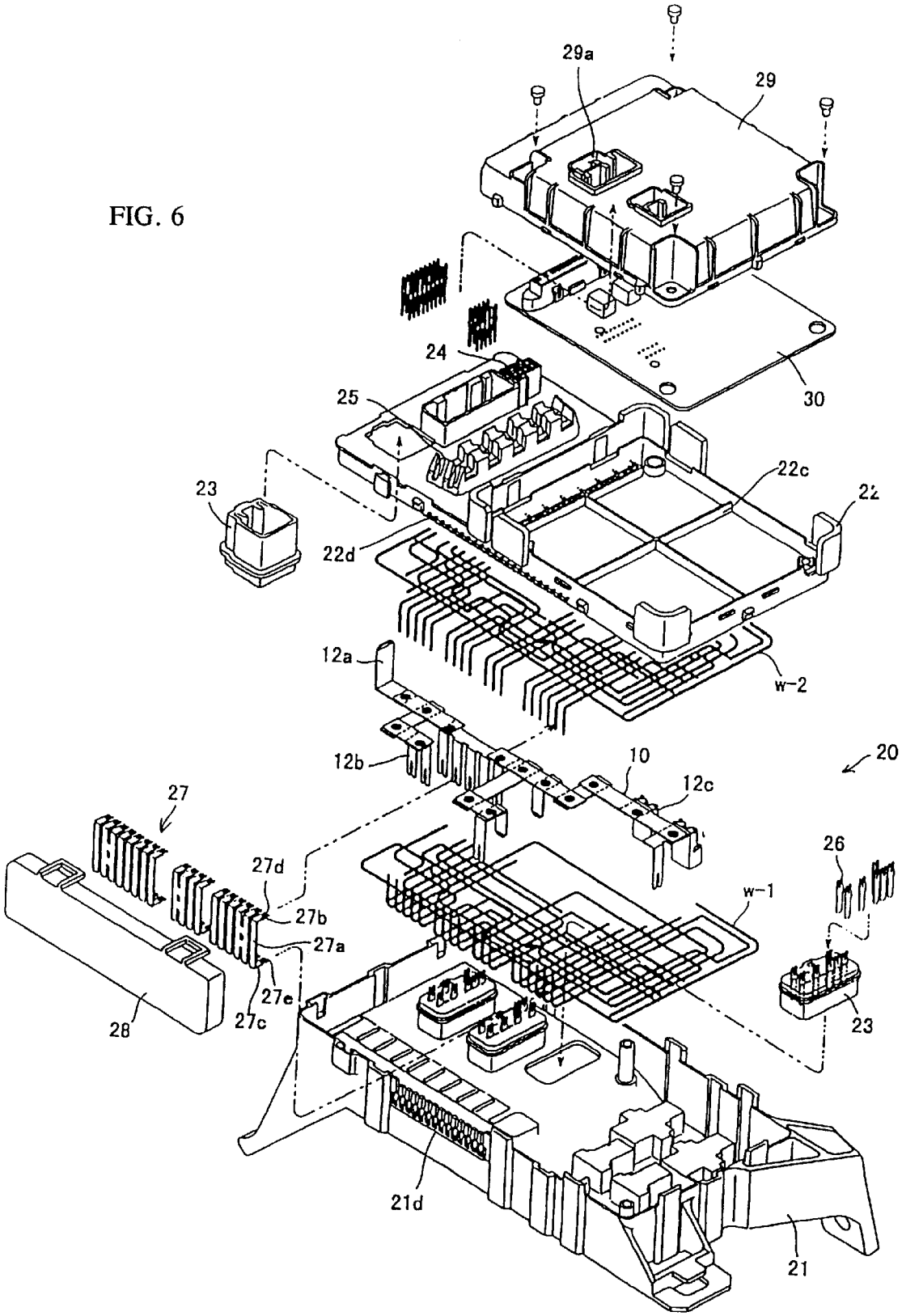
FIG. 6 is an exploded perspective view showing a first electrical junction box of the present invention.

FIG. 1 shows an electrical circuit member 10 in the form of a bus bar used in the electrical junction box of the present invention shown in FIG. 6. The circuit member 10 is constructed of rectangular one-piece spine parts 11-1–11-8 and terminal one-piece parts 12-1–12-7 joined therewith. The terminal parts 12-1–12-7 have upright or vertical terminal-forming portions 12*d*-1–12*d*-7 and horizontal front portions 12*e*-1–12*e*-7, respectively. The spine parts 11-1, 11-2, 11-3 constitute a first branched spine of the bus bar, and the spine parts 11-4 to 11-8 a second branched spine.

Figure 2:
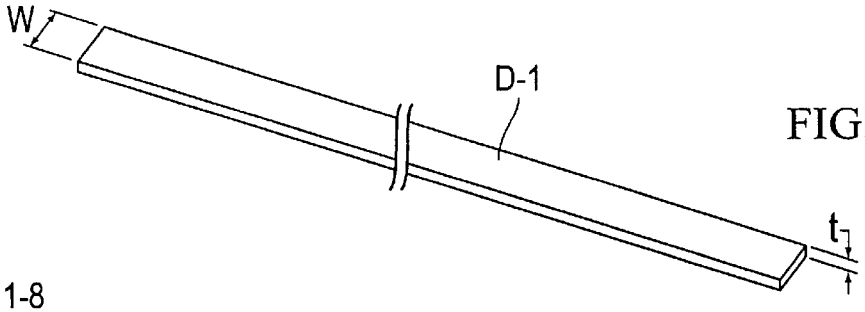
FIGS. 2(A) and 2(B) are perspective views showing the process of producing portions of the bus bar shown in FIG. 1.
Figure 2:
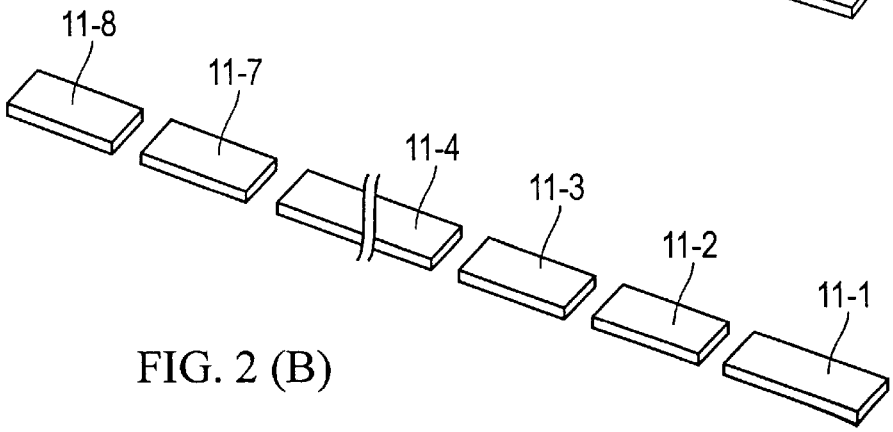

As shown in FIGS. 2(A) and 2(B), the rectangular spine parts 11-1–11-8 are produced by cutting, to the required lengths, a ribbon material D-1 of electrically conductive sheet made of brass or copper alloy and having a predetermined thickness t and a predetermined uniform width w, selected so that the material D-1 has a cross-sectional area corresponding to the value of electric current to flow through the bus bar and has a sufficient contact area when the spine parts and terminal parts are connected. The cutting length of the spine parts 11-1–11-8 corresponds to the designed circuit configuration. The parts 11-1–11-8 may be cut in correspondence to various standard dimensions selected for their use as general-purpose connection materials.

As shown in FIG. 1, the terminal parts 12-1–12-7 include a type 12-1, 12-5 having flat tabs 12*a*-1, 12*a*-5 formed at the end of the vertical portions 12*d*-1, 12*d*-5; a type 12-2 having cut-out slots 12*b*-2 providing a pressure-contact blade formed at the end of the vertical portion 12*d*-2; and a type 12-6 having a female terminal 12*c*-6 formed at an end of the vertical portion thereof. The configuration of the terminal parts is classified into the following two types: the approximately L-shaped terminal parts 12-1 and the like having one vertical portion and the horizontal portion; and the approximately U-shaped terminal parts 12-4 and the like having two terminal-forming vertical portions and the horizontal portion. The U-shaped part 12-4 has its vertical portions 12*d*-4 located at opposite ends of the horizontal portion 12*e*-4. The U-shaped type part, such as part 12-4, may have any one of a tab 12*a*, a slot 12*b*, and a female terminal 12*c* at the end of each vertical portion thereof.

As shown in FIGS. 3(A) to 3(C), the L-shaped part 12-1, etc. is formed by punching an electrically conductive sheet D-2 of brass or a copper alloy into a required configuration using a punching machine or the like, and then bending the punched plate. In forming the terminal parts 12-1, etc. the conductive sheet D-2 is so punched and bent out that the tab 12*a* is shaped thereon, and to form the pressure-contact blade at the end of the vertical portion 12*d*, the conductive plate D-2 is so punched that the slot 12*b* is formed thereon. In a manner not shown the terminal part having the female terminal at the end of the vertical portion, the conductive sheet is so punched that the material for the female terminal is formed thereon and then bent to the desired shape.

Thereafter, unrequired portions shown by oblique lines in FIGS. 3(A) and 3(B) are cut off from the conductive plate D-2. In this manner, the approximately L-shaped terminals 12-1, 12-2, 12-3, 12-5 are formed. The above-described manufacturing procedure may be altered appropriately in consideration of workability.

Figure 4:
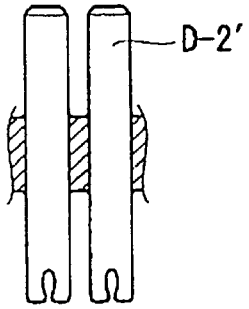
FIGS. 4(A), 4(B) and 4(C) are views showing the process of producing approximately U-shaped terminal-forming members of the bus bar of FIG. 1.
FIGS. 4(D) and 4(E) are perspective views showing another approximately U-shaped terminal-forming member of the bus bar of FIG. 1.
Figure 4:
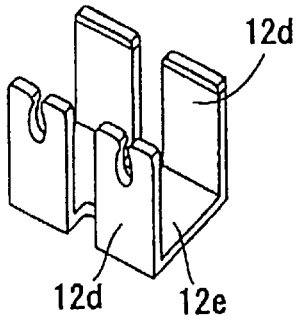
Figure 4:
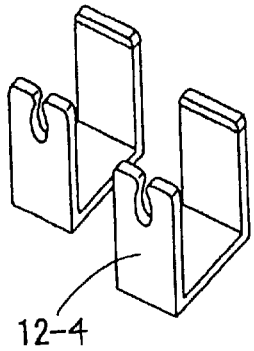
Figure 4:
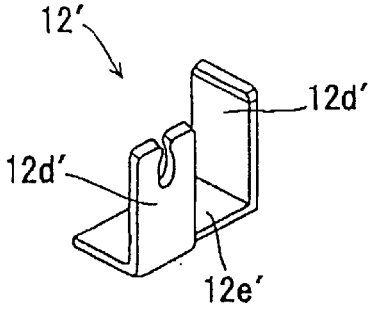
Figure 4:
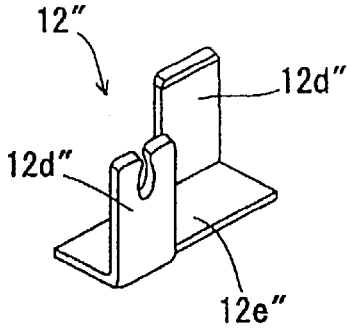

As shown in FIGS. 4(A) to 4(C), the U-shaped terminal part 12-4 is formed by punching and bending an electrically conductive sheet D-2', and then cutting off unrequired portions (oblique lines in FIG. 4(A)). It is not essential that the vertical portions 12*d* are opposed to each other, and they may have a position relationship as shown for terminal parts 12', 12" in FIGS. 4(D) and 4(E) with vertical portions 12*d*' and 12*d*' respectively.

The L-shaped and U-shaped terminal parts 12-1 etc. are not used exclusively for one type of vehicle or specification, but can be used for other types of vehicles and other specifications. By standardizing the dimensions of the vertical portions 12*d* and the horizontal portions 12*e*, these parts may be used for a variety of types of vehicles or specifications. The configuration of the terminal part is not limited to the L and U shape, but any desired shapes may be adopted which have the vertical portion and the horizontal portion.

The bus bar or electrical circuit member 10 shown in FIG. 1 is constricted as follows as a combination of the spine parts 11-1 etc. and the terminal parts 12-1 etc. These parts 11 and 12 are connected with each other by welding, with spine parts 11-1 etc. disposed horizontally and all in parallel planes and overlapping the horizontal foot portions of the terminal parts 12-1 etc. In this manner, the terminal parts 12-1 etc. are connected with the sequential spine parts 11-1 etc. More specifically, the spine parts 11-1 etc. are welded to each other to form a base connection structure by overlapping them linearly or perpendicularly according to a designed configuration of a circuit. Then, the base connection structure and the terminal parts 12-1 etc. are welded at required positions corresponding to the designed circuit. The overlapping direction of the spine parts 11-1 etc. may be oblique. In the embodiment of FIG. 1 it can be seen that the terminal part 12-3 bridges between two bus bar spines formed by the spine parts 11-1 to 11-3 and 11-4 to 11-8 respectively.

Figure 5:
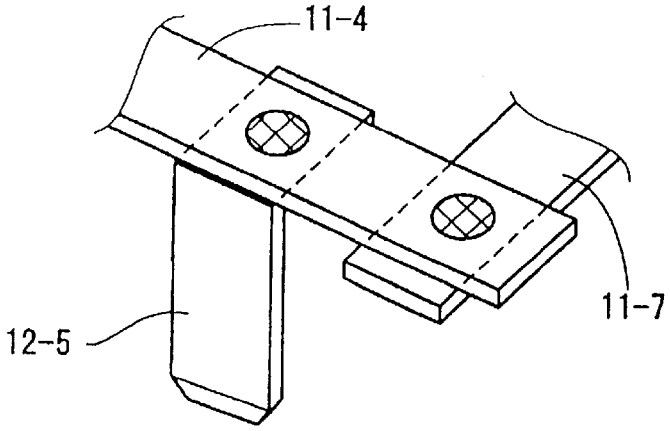
FIG. 5(A) is a partial perspective view how parts of the bus bar of FIG. 1 are connected with each other.
FIGS. 5(B) and 5(C) are perspective views showing another method by which parts of the bus bar of FIG. 1 are connected with each other by rivets.
Figure 5:
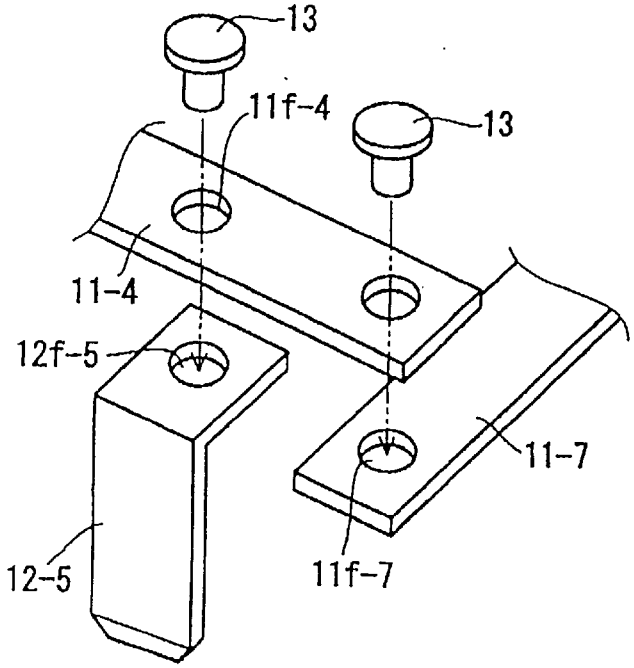
Figure 5:
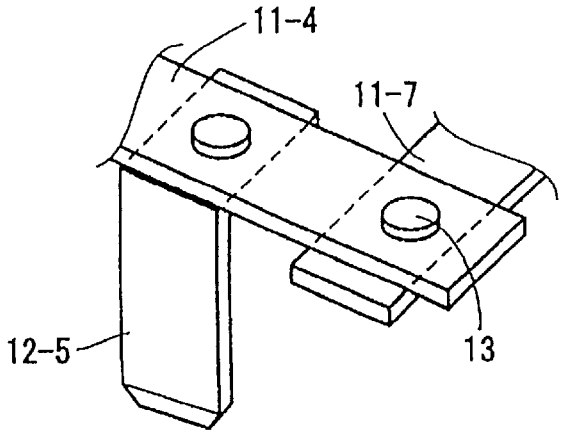

As shown in FIG. 5(A), by way of example of the welding operation to connect the spine parts 11 and the terminal parts 12 with one another, the terminal part 12-5 and the spine part 11-7 are brought into flat contact with the spine part 11-4. Then, they are welded to each other by sandwiching contact portions with resistance welding electrodes (not shown). As the resistance welding, spot welding or the like is used. As other welding methods, laser welding and ultrasonic welding may be used.

As an alternative to welding, rivets 13 may be used to connect the parts with each other, as shown in FIGS. 5(B) and 5(C). To insert the rivet 13, holes 11*f*-4, 12*f*-5, etc. are punched in the parts. Then the parts are overlapped flat on each other such that the holes 11*f*-4, 12*f*-5 communicate with each other. The rivet 13 is inserted into the insertion holes 11*f*-4, 12*f*-5. A fastening head is formed on the rivet 13 with a rivet hammer (not shown). Other insertion holes are connected with each other by the above-described method. Alternatively to the above-described connection methods, soldering may be used or any other suitable method.

The configuration of the bus bar 10 is not limited to that shown in FIG. 1. It is possible to form the bus bar with a wide range of configurations by combining the spine parts 11 and the terminal parts 12 with each other, according to desired circuit configurations.

FIG. 6 shows an electric junction box 20 accommodating the bus bar 10 of FIG. 1 as a power source circuit. The electric junction box 20 includes a lower case 21 and an upper case 22. The bus bar 10 is located between a lower electrical wiring layer w-1 and an upper electrical wiring layer w-2 extending on the lower and upper cases respectively.

Figure 7:
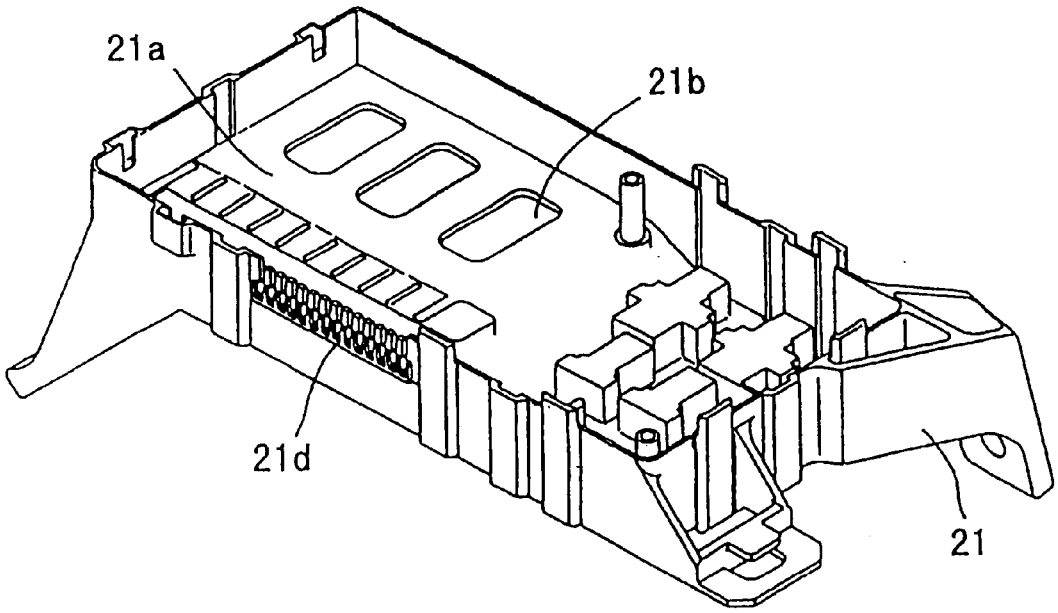
FIG. 7(A) is a perspective view showing a lower case of the junction box of FIG. 6.
FIG. 7(B) is a perspective view showing an upper case of the junction box of FIG. 6.
Figure 7:
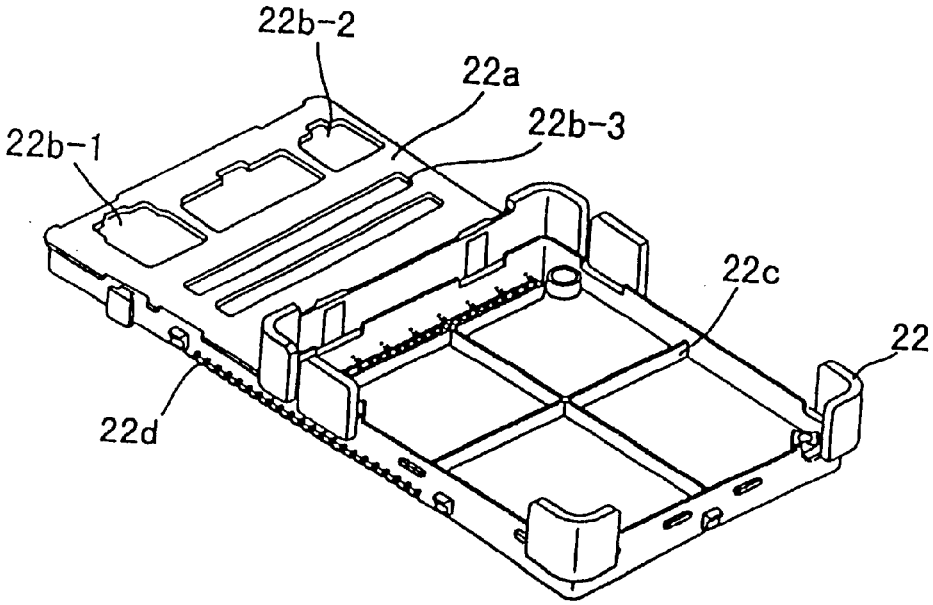
Figure 10:
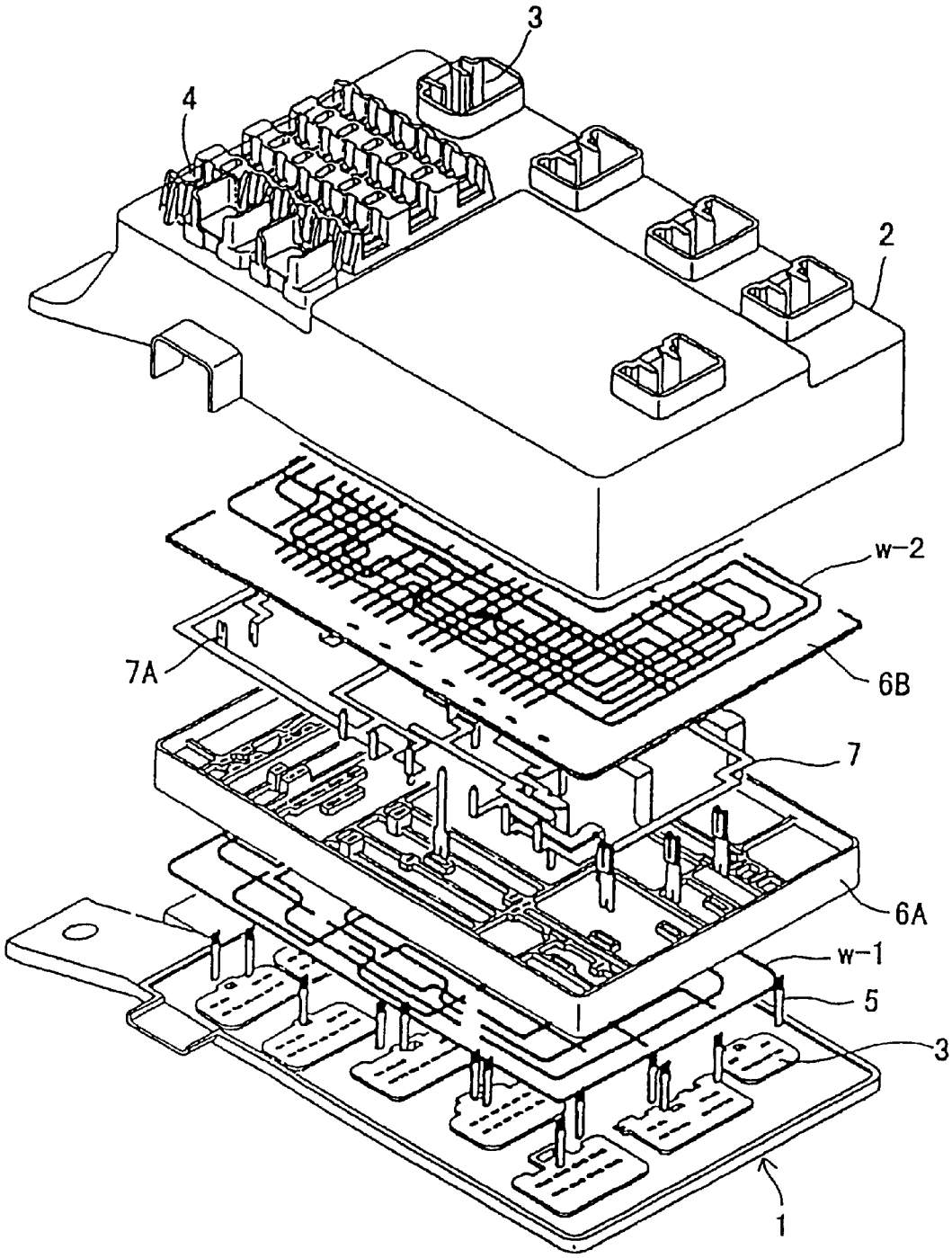
FIG. 10 PRIOR ART
FIG. 10 is an exploded perspective view showing a conventional electric junction box.

The lower case 21 and upper case 22 shown in FIGS. 7(A) and 7(B) are made of molded resin. On a lower surface 21*a* of the lower case 21 and an upper surface 22*a* of the upper case 22, there are formed openings 21*b*, 22*b*-1, 22*b*-2, and 22*b*-3 on which a connector 23, a relay socket 24, and a fuse socket 25 can be removably installed. The arrangement of the openings 21*b*, 22*b*1, 22*b*2, and 22*b*3 is not limited to the state shown in FIGS. 7(A) and 7(B). For example, they may be formed in a desired number and in a required configuration, according to the number of points of connection between internal and external circuits to be accommodated in the electric junction box and the required number of relays and fuses. At a position of the upper surface 22*a* of the upper case 22, there is provided a rectangular electronic control unit-accommodating portion 22*c* having a wall at the periphery thereof. The configuration of the electronic control unit-accommodating portion 22*c* is not limited to that shown in FIG. 7(B), but may be appropriately altered according to the configuration of an electronic control unit 30 to be accommodated therein.

FIGS. 8(A), 8(B), and 8(C) show the connector 23, the relay socket 24, and the fuse socket 25 to be installed on the openings 21*b*, 22*b*1, etc. A pressure-contact terminal 26 is inserted into the connector 23 shown in FIG. 8(A) and a connector (not shown) for the external circuit is fitted on a connector fit-on portion 23*b* to connect the external circuit to the internal circuit. To accomplish a stable installation of the connector 23, a flange portion 23*a* is formed on the periphery thereof. The dimension of the connector 23 can be set appropriately according to the number of terminals to be connected therewith. For common use, a standardized dimension of the connector 23 may be set.

A relay (not shown) is inserted into the relay socket 24 shown in FIG. 8(B). A relay insertion portion 24*b* is formed on the upper surface of the relay socket 24, and a flange portion 24*a* is formed on the periphery thereof. A fuse (not shown) is inserted into the fuse socket 25 shown in FIG. 8(C). Similarly, a fuse insertion portion 25*b* is formed on the upper surface of the fuse socket 25, and a flange portion 25*a* is formed on the periphery thereof. For common use, a standardized dimension of the outer diameter of the relay socket 24 and that of the fuse socket 25 may be set.

The connector 23, the relay socket 24, and the fuse socket 25 are fixedly installed on the openings 21*b*, 22*b*1, etc. of the lower case 21 and the upper case 22. To close the opening 21*b* in constructing the circuit, a closing cover 26 shown in FIG. 8(D) is mounted on an opening 21*b* on which the connector 23 is not required to be mounted. In the case where it is necessary to secure the connector 23 and the like firmly, welding or an adhesive agent may be used.

As shown in FIG. 9, the lower case 21 and the upper case 22 are arranged, with the inner surfaces thereof upward and a gap C formed therebetween. In this state, the electrical wiring w of single-core wires is extended along the inner surface of the lower case 21 and that of the upper case 22, with the wiring w spanning the gap C, and the wires are connected under pressure with the pressure-contact terminals 26 installed on the lower case 21 and the upper case 22. After the electrical wiring w is wired in this manner, it is cut as shown by the two-dot chain line of FIG. 9 to separate it into the wiring layer w-1 located on the lower case 21 and the wiring layer w-2 located on the upper case 22.

Referring to FIG. 6, after the electrical wiring w is cut, the bus bar 10 is located between the wiring layer w-1 and w-2, and the upward tab 12*a* of the bus bar 10 is inserted into the connector 23, the slot terminal parts 12*b* are connected with the wiring layers w-1 and w-2 as appropriate by pressure fitting, the female terminal 12*c* is positioned below the relay socket 24, and the lower case 21 and the upper case 22 are combined with each other. In this manner, the electrical junction box 20 is assembled. The wiring layers w-1 and w-2 forming the internal circuit of the electric junction box 20 are connected with each other and with a connection bus bar 27.

As also shown in FIG. 6, an electrically conductive plate is shaped into a required configuration to form a connection bus bar 27. The upper and lower ends of a vertical portion 27*a* are bent at 90° to form upper and lower horizontal portions 27*b*, 27*c*, and pressure-contact blades 27*d*, 27*e* are formed at the ends of the upper and lower horizontal portions 27*b*, 27*c*. The connection bus bar 27 is disposed along side surfaces of the lower case 21 and the upper case 22 and locked to connection locking portions 21*d*, 22*d* formed on the side surfaces of the lower case 21 and the upper case 22, in order to connect the connection bus bar 27 with the electric wires w-1 and w-2 by means of the pressure-contact blades 27*d*, 27*e*. Then, a protection cover 28 is installed on the connection bus bar 27.

The electronic control unit 30 including a printed circuit board provided with various electronic parts is mounted on the electronic control unit-accommodating portion 22*c* of the upper case 22. Then, for protection of electronic and electric parts, a cover 29 having a connector 29*a* is mounted on the electronic control unit 30.

The above-described procedure of manufacturing the electrical junction box may be altered appropriately, for example in consideration of workability. The construction and arrangement of the junction box is not limited to what is described above. For example, connectors and the like may be integral with the lower case and the upper case to form a simple construction. The mounting of the electronic control unit on the junction box is not essential. Further, it is possible to provide a plurality of electric wires and electric circuit members through insulation plates and the like to form a multi-layer laminated structure. The bus bar may be used not only as the power source circuit but alternatively as a circuit for other functions in the internal circuit.

As apparent from the foregoing description, the use of the bus bar used in the present invention eliminates the need for use of a punching die having a complicated configuration, as is required for a conventional bus bar, thus greatly reducing cost, particular cost required to manufacture the die. Further, the bus bar used in the present invention is formed by combination of the one-piece terminal parts and the one-piece spine parts, which can be assembled in a very wide variety of circuit configurations by appropriately shaping and combining the parts. Thus, in vehicles, such as automobiles, the bus bar can be used for different types of vehicles and different specifications. An appropriate alteration of the combination of the terminal parts and the spine parts allows the bus bar member to be easily and quickly adapted to include an improvement or modification of a circuit.

The electrical junction box can be produced easily by connecting upper and lower electrical wiring layers with the connection bus bar. Further, removable mounting of a connector and other parts on the upper and lower cases constituting the electrical junction box allows the upper and lower cases to have general-purpose property and flexibility for circuits of various configurations, thus allowing the bus bar to have variety and the electrical junction box to have a general purpose property. Further, because the upper case can accommodate an electronic control unit, it is possible to accommodate electronic and electric parts required to be connected with an external circuit in the electrical junction box in a high density or concentrated manner and to mount wire harnesses connecting circuits with one another in an improved manner.

Other embodiments of the present invention will be described below with reference to FIGS. 11 to 16. Parts corresponding exactly or in principle to those of FIGS. 1 to 9 have the same reference numbers (in FIGS. 14 and 15 with the addition of the prime mark, e.g. 10'), and will not be fully described again.

Figure 11:
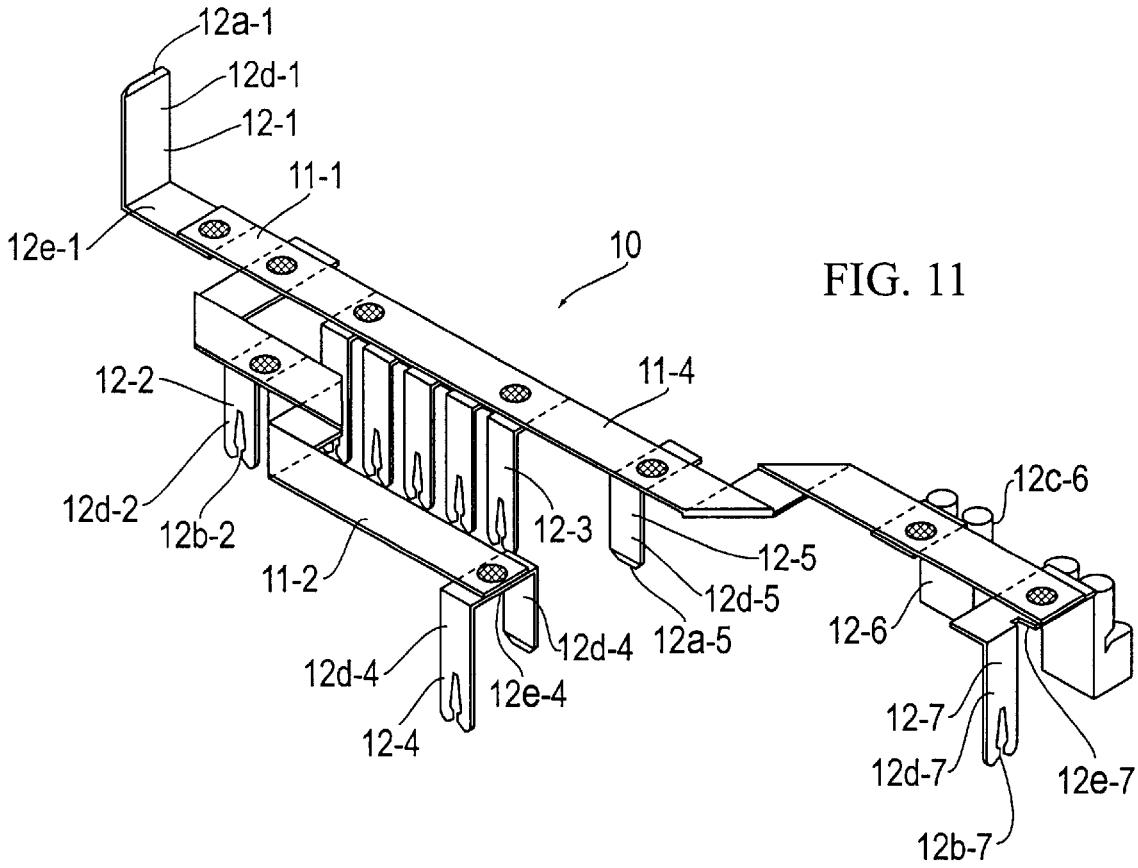
FIG. 11 is a perspective view showing a second bus bar used in a second electrical junction box of the present invention.

FIG. 11 shows a bus bar 10 of a second electrical junction box of the present invention. The bus bar 10 is constructed of one-piece spine parts 11-1, 11-2 and one-piece terminal parts 12-1–12-7 combined therewith. The terminal parts 12-1–12-7 are generally identical to those of FIG. 1.

Figure 12:
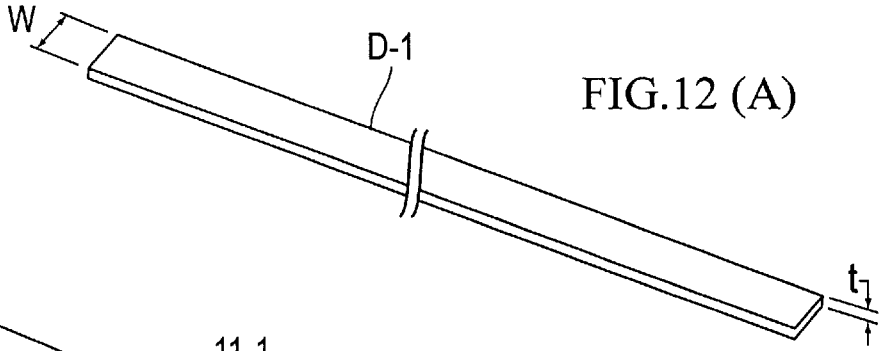
FIGS. 12(A) and 12(B) are perspective views showing the process of producing a member of the bus bar of FIG. 11.
Figure 12:
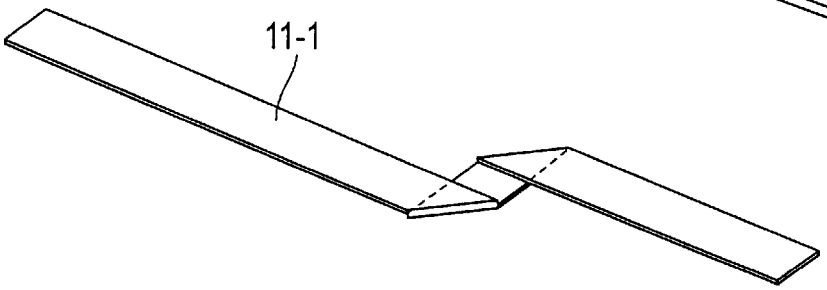
Figure 13:
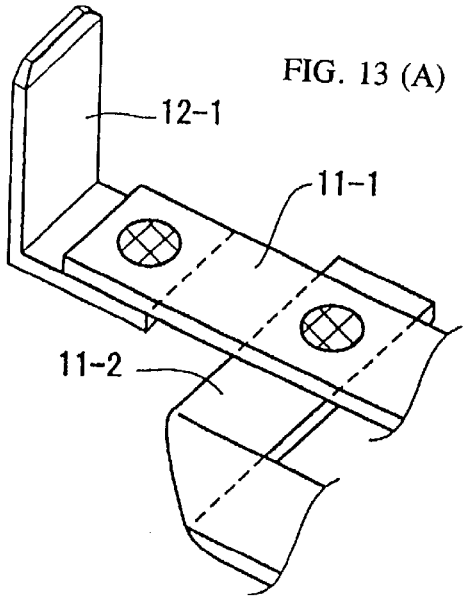
FIG. 13(A) is a perspective view showing how parts of the bus bar of FIG. 11 are connected with each other.
FIGS. 13(B) and 13(C) are perspective views showing another method by which parts of the bus bar of FIG. 11 are connected with each other by rivets.
Figure 13:
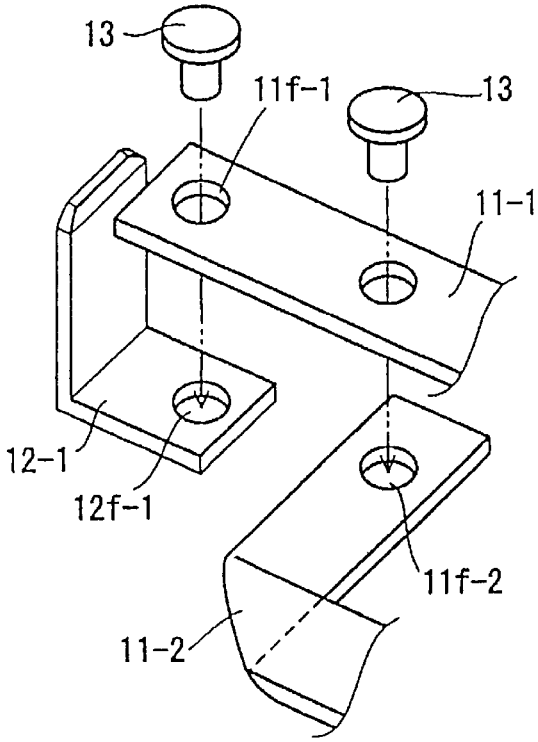
Figure 13:
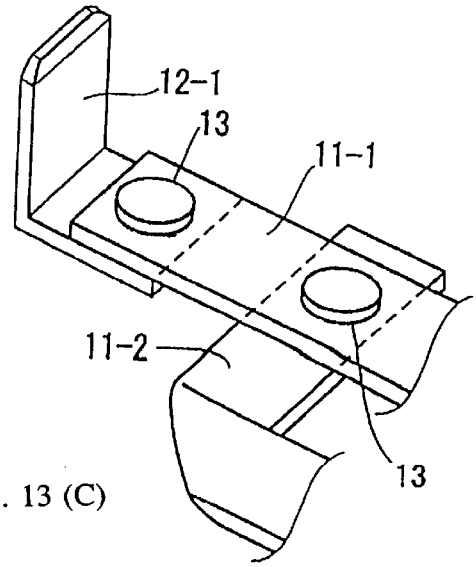

As shown in FIG. 12, the rectangular connection single-piece material 11-1 is produced by cutting, to a required length, a strip D-1 that is an electrically conductive sheet of brass or copper alloy and has a predetermined thickness t and a predetermined width w, and folding the strip D-1 at the required positions thereof. The resulting part 11-1 is generally horizontal and extends in required directions. The spine part 11-2 is formed similarly.

The fold lines in the strip D-1 are oblique (in this case at 45°) to the elongation direction of the unfolded straight strip of FIG. 12(A), and the strip is folded so that adjacent portions overlapping each other next to the fold line extend at right angles to each other and lie in closely adjacent parallel planes. By two such oblique fold lines, the extension direction can be shifted laterally, as shown in FIG. 12(B) for the spine part 11-1. The spine part 11-2 has three such oblique fold lines. The spine parts 11-1, 11-2 form a branched bus bar spine.

The bus bar 10 shown in FIG. 11 is constructed, in the same manner as the bus bar of FIG. 1, by the spine parts 11-1, 11-2 and the terminal parts 12-1 etc. The spine parts 11-1, 11-2 are welded to each other and to the horizontal foot portions of the terminal parts 12-1 etc., to form the desired circuit configuration. The overlapping direction of the spine parts may be linear or oblique according to the required circuit configuration. FIG. 13(A) illustrates the welding operation performed to connect the part 11-1, 11-2 and one terminal part 12-1 with one another, as described above in connection with FIG. 5(A).

As a connection method other than welding, rivets 13 may be used to connect the spine parts 11-1, 11-2 and the terminal parts 12-1 etc. with each other, as shown in FIGS. 13(B) and 13(C) and described above with reference to FIGS. 5(B) and 5(C).

Figure 14:
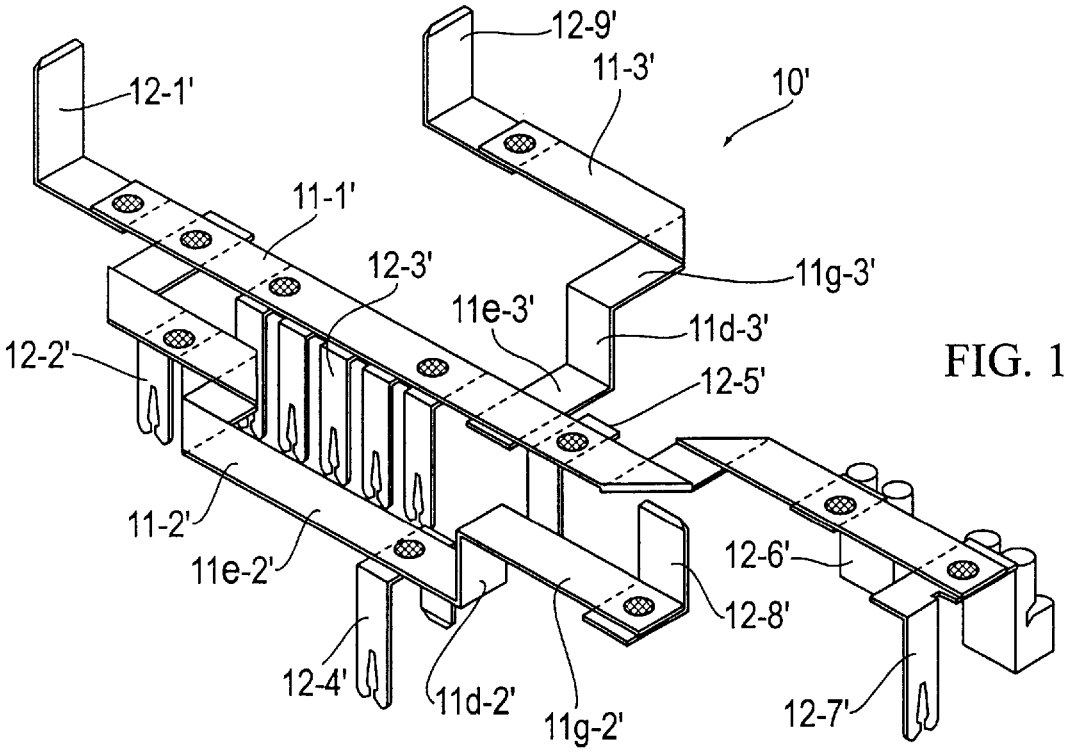
FIG. 14 is a perspective view showing a third bus bar which can be used in an electrical junction box of the present invention.
Figure 15:
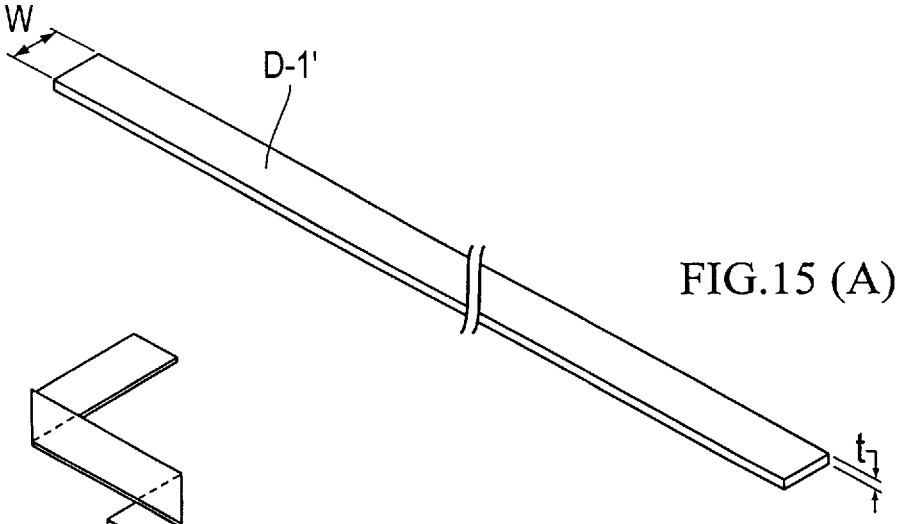
FIGS. 15(A) and 15(B) are perspective views showing the process of producing a spine part of the bus bar of FIG. 14.
Figure 15:
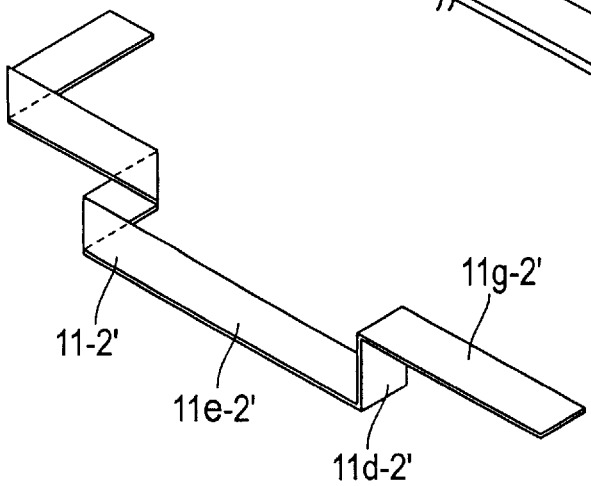

FIG. 14 shows a bus bar 10' which is a modified version of the bus bar of FIG. 11. To be applicable to a high-density internal circuit, the spine comprises three spine parts 11-1', 11-2' and 11-3', each containing at least one oblique fold line. In spine parts 11-2' and 11-3', first horizontal portions 11*e*-2', 11 *e*-3' and second horizontal portions 11*g*-2', 11*g*-3' are joined by vertical portions 11*d*-2' and 11*d*-3' at fold lines which are at right angles to the extension direction of the metal strip prior to folding. The bus bar 10' is constructed of these spine parts 11-1', 11-2', 11-3' with terminal parts 12-1'–12-9' connected therewith. The spine part 11-1' has a construction similar to that of spine part 11-1 of FIG. 11.

FIGS. 15(A) and 15(B) show how a metal strip length D-1' is bent at three oblique bend lines and two transverse bend lines to give the desired shape of the spine part 11-2'.

In a manner similar to that of FIGS. 1 and 11, the terminal parts 12-1'–12-9' are formed to have vertical and horizontal portions and a tab, a slot or female terminal at an end of the vertical portion thereof, respectively. The configuration of the bus bar 10' is not limited to that shown in FIG. 14. For example, the spine parts may have a plurality of vertical portions to allow the bus bar 10' to have two or more horizontal levels.

Figure 16:
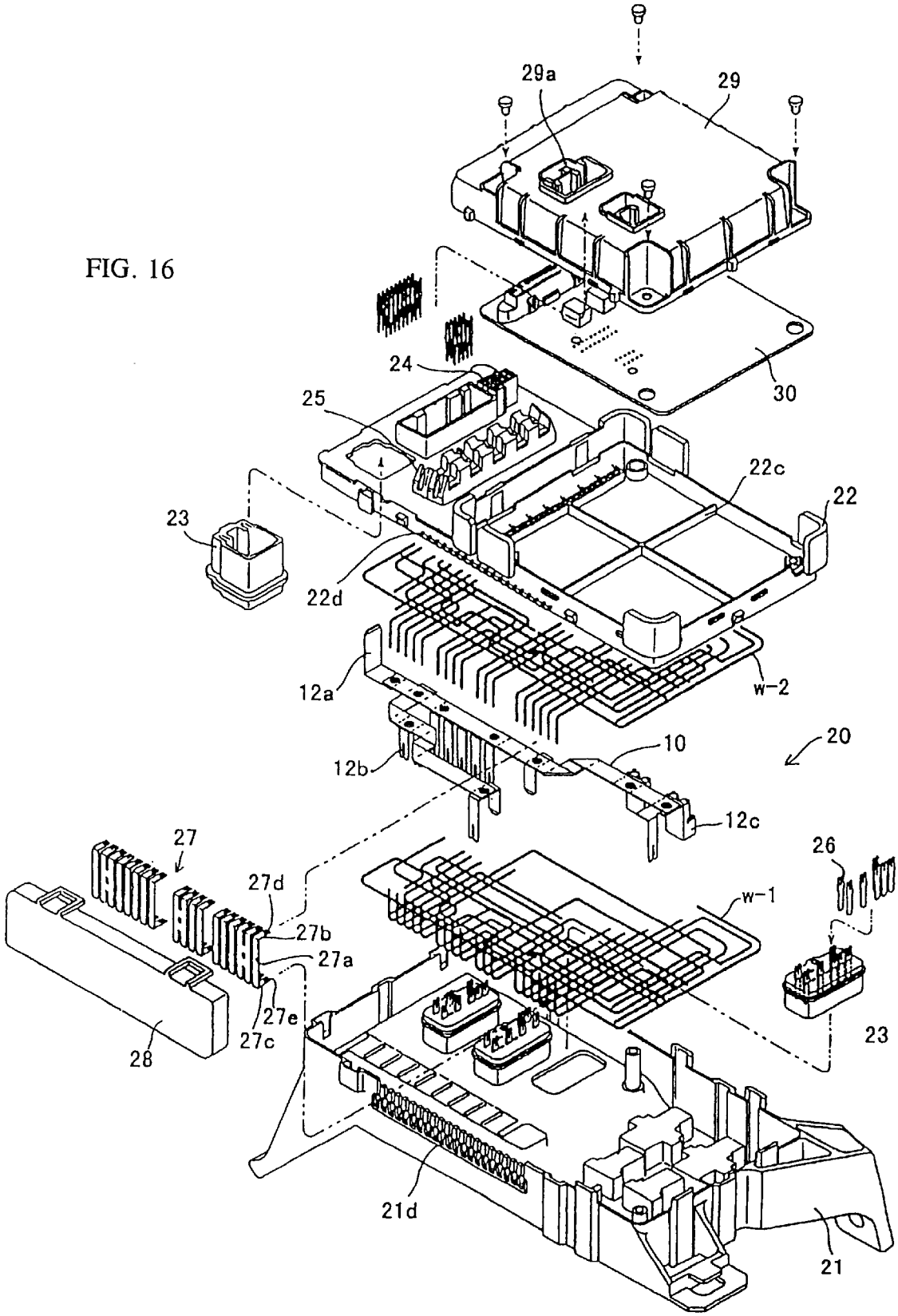
FIG. 16 is an exploded perspective view showing an electrical junction box of the present invention including the bus bar of FIG. 11.

FIG. 16 shows an electrical junction box 20 of the invention accommodating the bus bar 10 of FIG. 11 as a power source circuit. The junction box 20 of FIG. 16 is identical to that of FIGS. 6–9, except for the bus bar 10, and will not be described in detail again. The bus bar 10' of FIG. 14 may likewise be incorporated in an electrical junction box to form another embodiment of the invention.

The electrical junction box containing the bus bar 10 of FIG. 11 or bus bar 10' of FIG. 14 provides the same advantages as the embodiment of FIGS. 1 to 9.

A bus bar for use in another electrical junction box of the present invention will be described below with reference to FIGS. 17 to 24. In these figures parts corresponding in function to those of FIGS. 1 to 9 and 11 to 16 are given the same reference numbers with the addition of the double prime mark, e.g. 10", and their description will not be repeated except as necessary.

Figure 17:
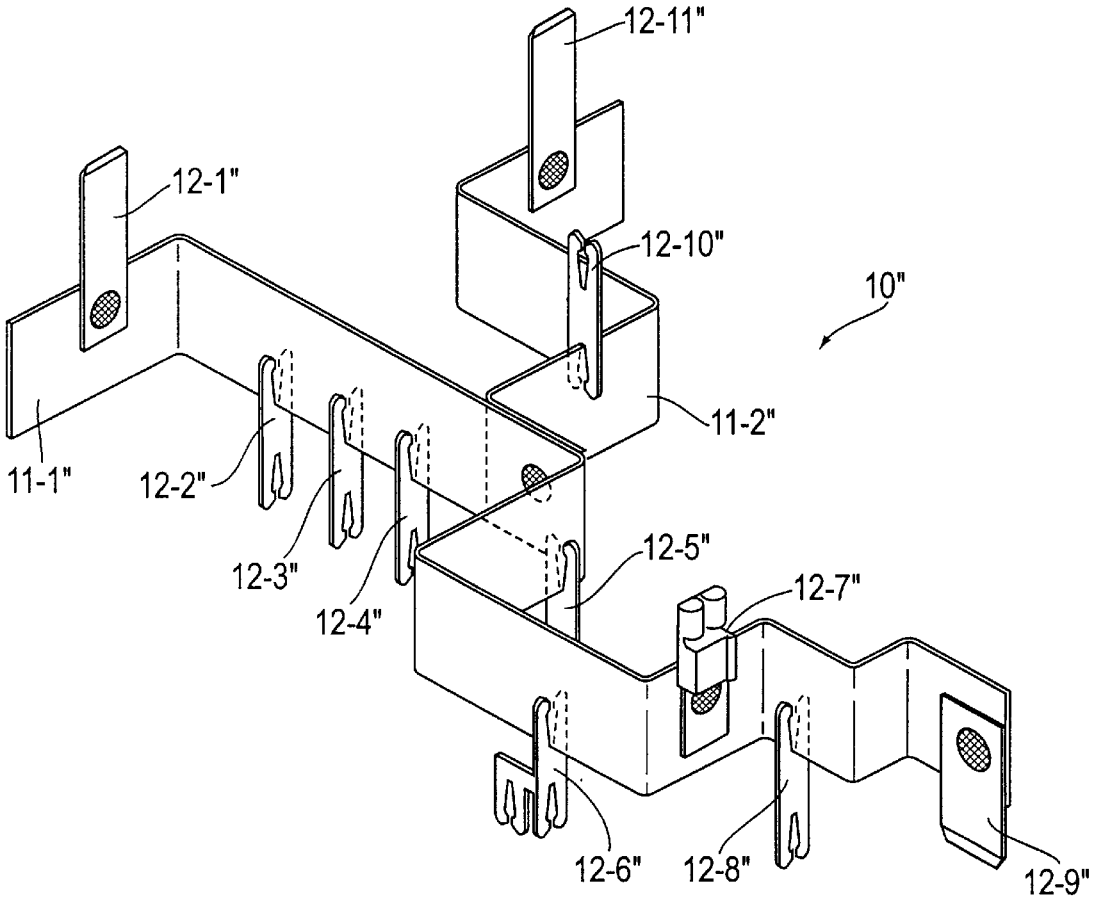
FIG. 17 is a perspective view showing a fourth bus bar used in an electrical junction box of the present invention.
Figure 18:
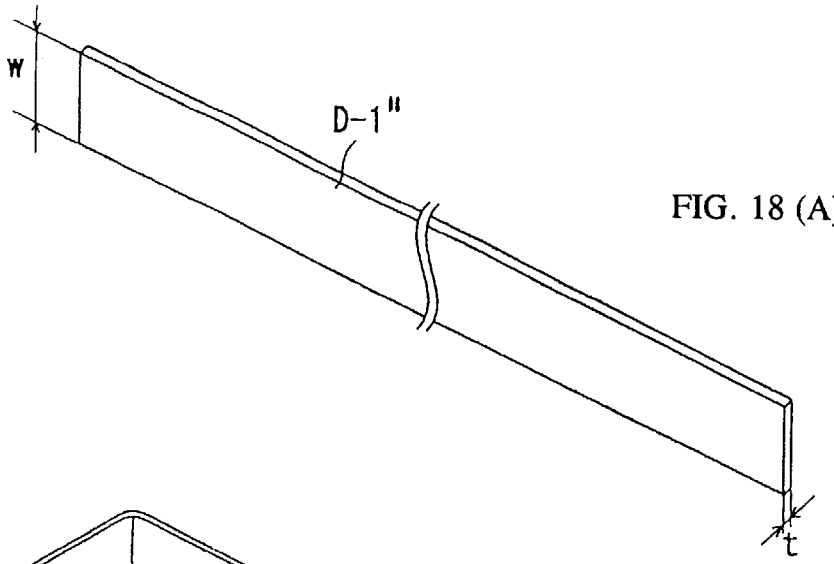
FIGS. 18(A) and 18(B) are perspective views showing the process of producing a member of the bus bar of FIG. 17.
Figure 18:
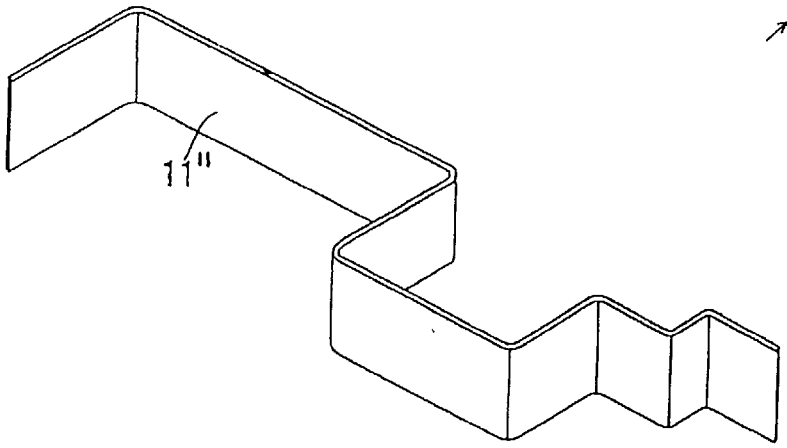
Figure 19:
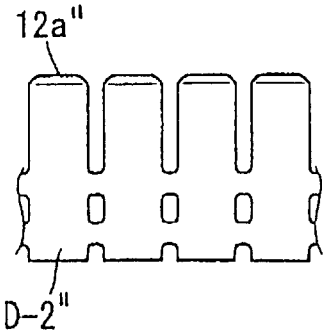
FIGS. 19(A) and 19(B) are plan views showing the process of producing flat terminal-forming members of the bus bar of FIG. 17.
Figure 19:
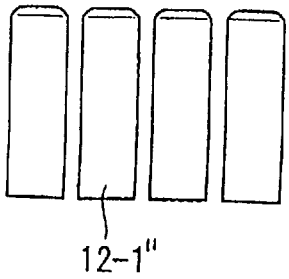
Figure 20:
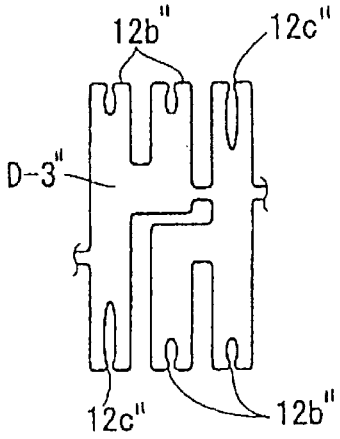
FIGS. 20(A) and 20(B) are plan views and FIG. 20(C) is a perspective view showing the process of producing another terminal-forming member of the bus bar of FIG. 17.
Figure 20:
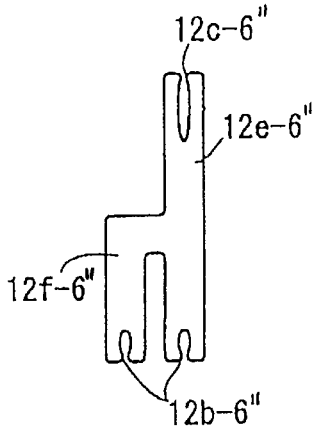
Figure 20:
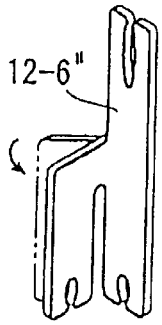
Figure 21:
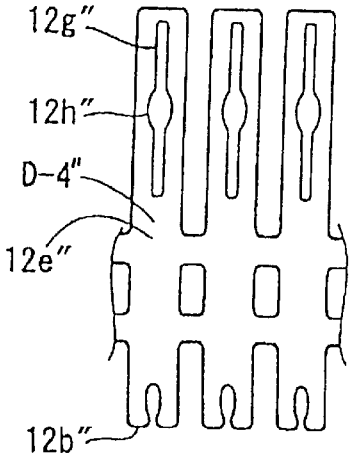
FIGS. 21(A) and 21(B) are plan views and FIG. 21(C) is a perspective view showing the process of producing yet another terminal-forming member of the bus bar of FIG. 17.
Figure 21:
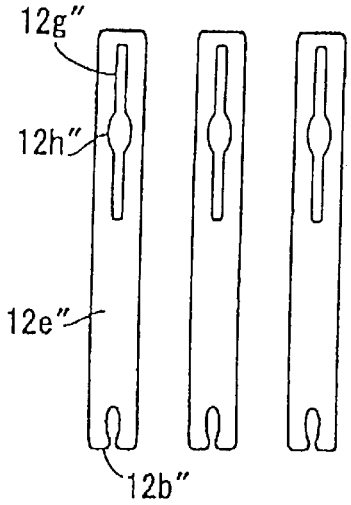
Figure 21:
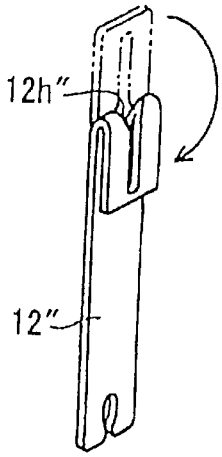
Figure 22:
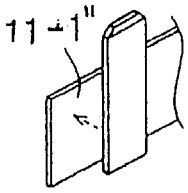
FIGS. 22(A) and 22(B) are perspective views showing how members of the bus bar of FIG. 17 are connected with each other by welding.
Figure 22:
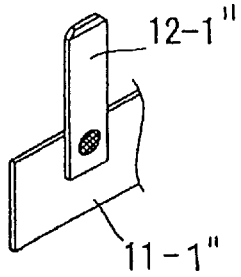
Figure 23:
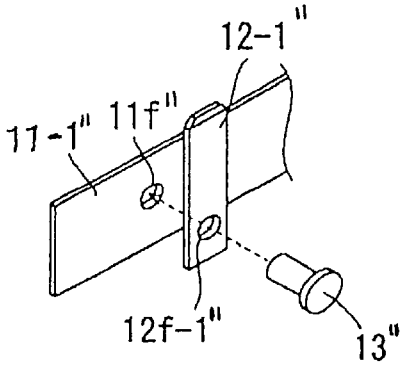
FIGS. 23(A) and 23(B) are perspective views showing how members of the bus bar of FIG. 17 are alternatively connected with each other by rivets.
Figure 23:
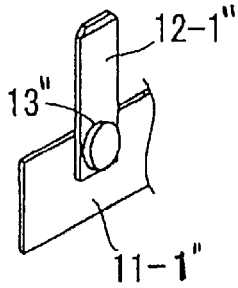
Figure 24:
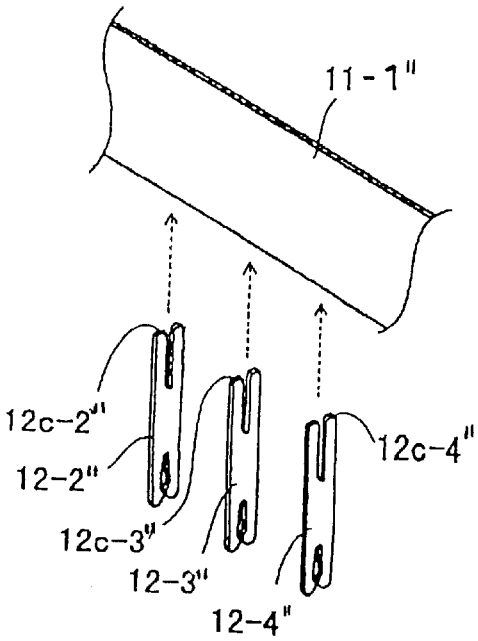
FIGS. 24(A) and 24(B) are perspective views showing how members of the bus bar of FIG. 17 are connected with each other by pressure-contact.
Figure 24:
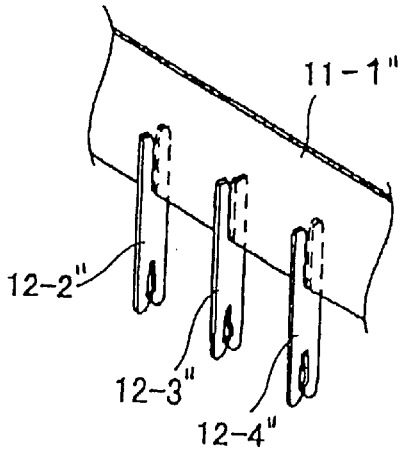

FIG. 17 shows the bus bar 10" of the present embodiment. The bus bar 10" is constructed of two one-piece spine parts 11-1", 11-2", which form a continuous branched bus bar spine, and one-piece terminal parts 12-1" to 12-11" which are joined to the spine parts 11-1" and 11-2" at foot portions lying flat against the spine parts and each have a terminal formed at an end of a vertical portion thereof.

As shown in FIGS. 18(A) and 18(B), the spine part 11-1" is produced by cutting, to a required length, a strip D-1" which is an electrically conductive sheet made of brass or copper alloy and having a predetermined uniform thickness t and a predetermined uniform width w and then folding the cut strip D-1" at required positions thereof corresponding to the designed configuration of an internal circuit of the junction box. The resulting spine part 11-1" is horizontal and extends in required directions. It includes vertical bend lines at which the extension direction changes by 90°, i.e. adjacent portions lie in mutually perpendicular planes.

As shown in FIG. 17, the terminal parts 12-1"–12-11" are classified into three types, according to the configuration of a terminal formed at an end thereof. The terminal parts 12-1", 12-9" and 12-11" are flat and have flat tabs formed at their ends as terminals. The terminal parts 12-2" -12-6", 12-8" and 12-10" have a connection cut-out, 12*c*-2" etc. (see FIG. 24) formed at one end thereof, into which the spine part 11-1" or 11-2" is inserted and have at their other ends pressure-contact blades with slots to receive and make electrical contact with inserted electrical wires. The terminal part 12-7" is flat and has a female terminal 12d-7" formed at its end. The formation of these terminal parts from punched flat metal sheet will now be described.

As shown in FIG. 19(A) and 19(B), an electrically conductive sheet D-2" of a brass or a copper alloy is punched with a punching pressing machine or the like and then cut to form the flat terminal parts 12-1", 12-9" and 12-11" each having a tab 12*a*" at an end thereof. Similarly, not shown, an electrically conductive sheet is punched and cut to form the flat terminal parts 12-2"–12-5", 12-8" and 12-10" having the slots 12*b*2" etc. and the cut-outs 12*c*-2" etc. at their respective ends. The width of the cut-out 12c-2" is set to be partly or entirely smaller than the thickness t of the strip of the spine parts 11-1", 11-2". An electrically conductive sheet, not shown, is punched and bent to form the terminal part 12-7" which has the female terminal 12*d*-7" at an end thereof.

As shown in FIGS. 20(A) to 20(C), to form the terminal part 12-6" having two slots 12*b*6" on one side thereof, an electrically conductive sheet D-3" is punched and cut to provide a second vertical portion 12*f*-6" in parallel with a first vertical portion 12*e*-6", a cut-out 12*c*-6" at one end of the first vertical portion 12e-6", and slots 12*b*-6" at the other ends of the first and second vertical portion 12*e*-6" and 12*f*-6". To reduce loss of material, in the sheet D-3" adjacent blanks for the terminal parts 12-6" are arranged mutually reversed in every punching operation, as FIG. 20(A) shows. After the punching and cutting operation terminates, the second vertical portion 12*f*-6" is bent at 90° in a direction shown by an arrow in FIG. 20(C) to form the terminal part 12-6". By forming the terminal part 12-6" in this manner, two electrical wires perpendicular to each other can be connected with one terminal part.

FIGS. 21(A) to 21(C) show production of a one-piece terminal part 12" which is a modified example of the terminal parts 12-2" etc. which are connected with the spine parts 11-1", 11-2" by insertion. An electrically conductive sheet D4" is punched and cut to form the terminal part 12" having an electric wire-connection slot 12*b*" formed at one end of a vertical portion 12*e*" and a long slot 12*g*" formed from a middle portion of the vertical portion 12*e*" to near the other end thereof. A wide portion 12*h*" is formed at the center of the long slot 12*g*" in its lengthwise direction. The width of the narrow part of the long slot 12*g*" is smaller than the thickness t of the connection single-piece material 11.

After the punching and cutting operation terminates, at the wide portion 12*h*' one side of the vertical portion 12*e*" is bent at 180° in a direction shown by an arrow in FIG. 21(C) to form the terminal part 12". The long slot 12*g*" thus formed serves as a cut-out for receiving the inserted spine part 11-1" or 11-2". Because the part having the long slot 12*g*" has a thickness twice as large as that of the vertical portion 12*c*", the spine part can be reliably fixed to the long slot 12*g*". Further, the wide portion 12*h*" is tapered and can guide the connection single-piece material 11 thereinto.

As with the terminal parts of FIGS. 1 to 9 and 11 to 16, the terminal parts 12-11"–12-11" and 12" are not specifically used for one type of vehicle or specification only, but can be used for other types of vehicles and other specifications by selectively using them in correspondence to a designed circuit configuration. By standardizing the dimension thereof, they may be used for a wide variety of types of vehicles or other specifications. The configurations of these terminal-forming single-piece materials are not limited to the above-described shapes, but any desired shapes may be adopted. For example, the type of the terminal-forming single-piece material having the tab formed at an end of the vertical portion thereof may have a connection cut-out to be connected with the spine part 11-1", 11-2" at the other end thereof.

The bus bar 10" shown in FIG. 17 is constructed by combining the spine parts 11-1" and 11-2" and the terminal parts 12-1"–12-11" by welding or pressure contact.

As shown in FIGS. 22(A) and 22(B), the spine part 11-1" and the terminal parts 12-1", 12-7", 12-9" are connected with one another by resistance welding. For example, to connecting the spine part 11-1" and the terminal part 12-1" with each other, with one end of a surface of the part 12-1" in contact with an upper portion of a required position of the spine part 11-1", the contact portion is sandwiched by electrodes (not shown) for resistance welding. As the resistance welding, spot welding or the like is used. As other welding methods, laser welding, ultrasonic welding, and the like may be used.

As a connection method other than welding, a rivet 13" may be used to connect the spine part 11-1" and the terminal parts 12-1", 12-7", 12-9" with each other, as shown in FIGS. 23(A) and 23(B). In the process of punching the spine part 11" and the terminal part 12-1" etc., insertion holes 11*f*-1", 12*f*-1" are punched; and the rivet 13" is inserted into the insertion holes 11*f*-1", 12*f*-1", with the spine part 11-1" and the terminal part 12-1" etc. overlapping each other such that the insertion holes 11*f*-1", 12*f*-1" communicate with each other. For the connection thereof, a fastening head is formed on the rivet 13 with a rivet hammer (not shown). Alternatively to welding or riveting, soldering may be used.

Referring to FIGS. 24(A) and 24(B), the spine part 11" and the terminal parts 12-2", 12-3", 12-4" are shown being connected with each other by pressure contact by fitting a lower portion of the spine part into the cut-out 12*c*-2" etc. of the terminal part 12-2" etc. such that the spine part is engaged by the terminal parts with gripping pressure. Because the width of the cut-out 12*c*-2" etc. is smaller than the thickness t of the spine part, the cut-out 12*c*-2" can be fixed to the spine part reliably with a tight fit.

When using the terminal part 12" of FIG. 21(C) the long slot 12*g*" is fitted onto the spine part 11-1" or 11-2".

As shown in FIG. 17, the bus bar 10" is formed as a branched bus bar by connecting the spine parts 11-1" and 11-2" with each other by welding. This arrangement is not limited to use of two spine parts. Additional spine parts may be connected as required.

The bus bar 10" is incorporated into an electrical junction box in the same manner as is shown in FIGS. 6 to 9 for the bus bar 10, and provides the same advantages of ease and flexibility of construction as have been described above.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A bus bar, comprising:

a spine formed of a plurality of one-piece metal strip parts joined together at mutually overlapping portions thereof to form a branched structure; and a plurality of terminal parts formed of a metal sheet having a foot portion and a terminal-forming portion, each of the foot portions lying flat against the spine and being joined to the spine, wherein the plurality of one-piece metal strips forming the spine do not form the at least one terminal part and at least one terminal part is joined to each branch of the spine.

2. A bus bar according to claim 1, wherein the terminal part is a one-piece part formed of a metal sheet selected from:

(i) an L-shaped part in which said foot portion is one leg of the L-shape and (ii) a U-shaped part in which said foot portion is the base of the U-shape.

3. A bus bar according to claim 1, wherein the one-piece metal strip parts of the spine are all formed of a metal strip having a uniform strip width.

4. A bus bar according to claim 1, wherein the metal strip parts of the spine are joined together by at least one of riveting and welding, and the foot portions of the terminal parts are joined to the spine by at least one of riveting and welding.

5. A bus bar according to claim 1, wherein the at least one of the one-piece metal strip parts of the spine have at least one oblique bend line at which point two adjacent portions which lie in parallel planes and extend in different directions are joined.

6. A bus bar according to claim 1, wherein the at least one of the one-piece metal strip parts of the spine have at least one right-angle bend at which point two adjacent portions which are in mutually perpendicular planes are joined.

7. A bus bar according to claim 1, wherein at least one of the one-piece metal strip parts of the spine have at least one oblique bend line at which point two adjacent portions which lie in parallel planes and extend in different directions are joined and at least one right-angle bend at which point two adjacent portions which are in mutually perpendicular planes are joined.

8. A bus bar according to claim 6, wherein the foot portion of each terminal part is coplanar with at least part of the terminal-forming portion.

9. A bus bar, comprising:

a one-piece spine member formed of a metal sheet strip having:

(i) at least one first bend at an oblique bend line at which are joined two adjacent portions thereof which lie in parallel planes and extend in different directions with mutual overlap; and (ii) at least one second bend which is a right-angle bend at which are joined two adjacent portions thereof which are in mutually perpendicular planes; and (iii) at least one terminal part formed of a piece of sheet strip bent to provide a foot portion and an upright portion perpendicular to the foot portion, the foot portion lying flat against the spine member and being joined thereto.

10. A bus bar according to claim 1, wherein the bus bar is a power source circuit.

11. A bus bar according to claim 9, wherein the bus bar is a power source circuit.

12. An electrical junction box, comprising:

an upper casing;

a first electrical wiring extending over an inner surface of the upper casing;

pressure-contact terminals disposed on the upper casing and connected to the first wiring;

a lower casing;

a second electrical wiring extending over the lower casing;

pressure-contact terminals disposed on the lower casing and connected to the second wiring;

at least one electrical connection member disposed within the box selected from a plurality of different electrical connection members and connecting the first and second wirings;

at least one bus bar disposed in the box between the first and second wirings, the bus bar including a spine formed of a plurality of one-piece metal strip parts joined together at mutually overlapping portions thereof, and at least one terminal part formed of a metal sheet having a foot portion and a terminal-forming portion, the foot portion lying flat against the spine and being joined to the spine and the plurality of one-piece metal strips forming the spine do not form the at least one terminal part; and p1 at least one circuit board selected from a plurality of available circuit boards connected by the first and second wirings and the bus bar, wherein the bus bar and electrical connection members are configurable to the selected at least one circuit board.

13. An electrical junction box according to claim 12, the bus bar further comprising:

a one-piece spine member formed of a metal sheet strip having (i) at least one first bend at an oblique bend line at which are joined two adjacent portions thereof which lie in parallel planes and extend in different directions with mutual overlap; and (ii) at least one second bend which is a right-angle bend at which are joined two adjacent portions thereof which are in mutually perpendicular planes; and (iii) at least one terminal part formed of a piece of sheet strip bent to provide a foot portion and an upright portion perpendicular to the foot portion, the foot portion lying flat against the spine member and being joined thereto.

* * * * *